United States Patent [19]

Walker

[11] Patent Number: 4,856,449

[45] Date of Patent: Aug. 15, 1989

[54] WINGSAIL STALLING

[76] Inventor: John G. Walker, Tipwell House, St. Mellion, Cornwall, United Kingdom, PL12 8RS

[21] Appl. No.: 222,824

[22] Filed: Jul. 22, 1988

Related U.S. Application Data

[63] Continuation-in-part of Ser. No. 5,167, Jan. 2, 1987, Pat. No. 4,770,113.

[30] Foreign Application Priority Data

| | | | |
|---|---|---|---|
| May 2, 1985 | [GB] | United Kingdom | 8511232 |
| May 2, 1985 | [GB] | United Kingdom | 8511233 |
| May 2, 1985 | [GB] | United Kingdom | 8511234 |
| May 2, 1985 | [GB] | United Kingdom | 8511235 |
| Feb. 12, 1988 | [GB] | United Kingdom | 8803265 |

[51] Int. Cl.[4] ..... B63H 9/04

[52] U.S. Cl. ..... 114/103

[58] Field of Search ..... 114/39.1, 102, 103, 114/105, 104; 244/45 R, 78, 82

[56] References Cited

U.S. PATENT DOCUMENTS

| | | | |
|---|---|---|---|
| 4,467,741 | 8/1984 | Walker | 114/103 |
| 4,473,023 | 9/1984 | Walker | 114/103 |

FOREIGN PATENT DOCUMENTS

| | | | |
|---|---|---|---|
| 403416 | 9/1924 | Fed. Rep. of Germany | 114/39.1 |
| 8604035 | 7/1986 | PCT Int'l Appl. | 114/102 |

*Primary Examiner*—Joseph F. Peters, Jr.
*Assistant Examiner*—Jesûs D. Sotelo
*Attorney, Agent, or Firm*—Young & Thompson

[57] ABSTRACT

Wingsail configurations for multi element wingsails for maintaining full stall for maximum speed in running downwind in which the trailing edges of at least a pair of flap elements of a multi element structure are maintained in the convergent configuration so that in the deflected position of the flap there is a leeward progression to deeper stalling.

12 Claims, 3 Drawing Sheets

FIG. 1
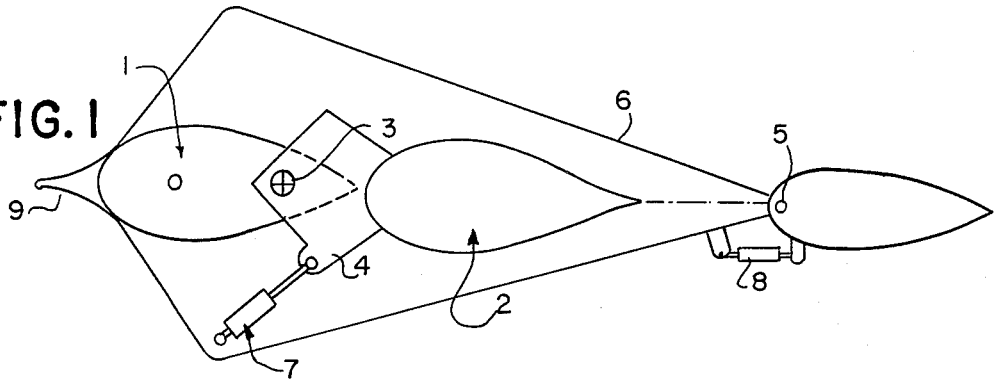
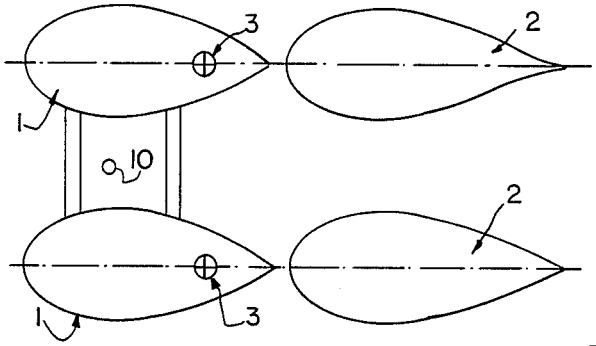
FIG. 3
FIG. 4
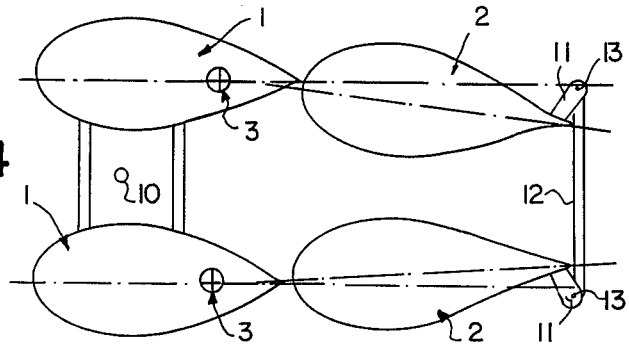
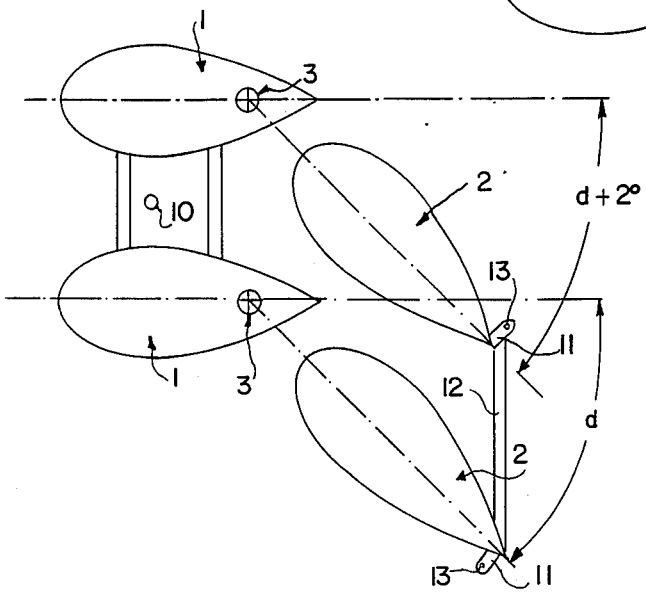
FIG. 5

FIG. 6
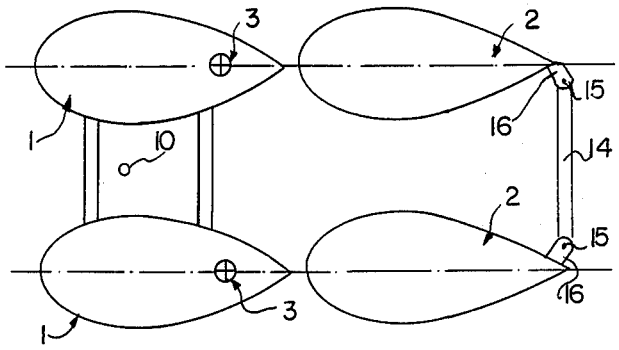
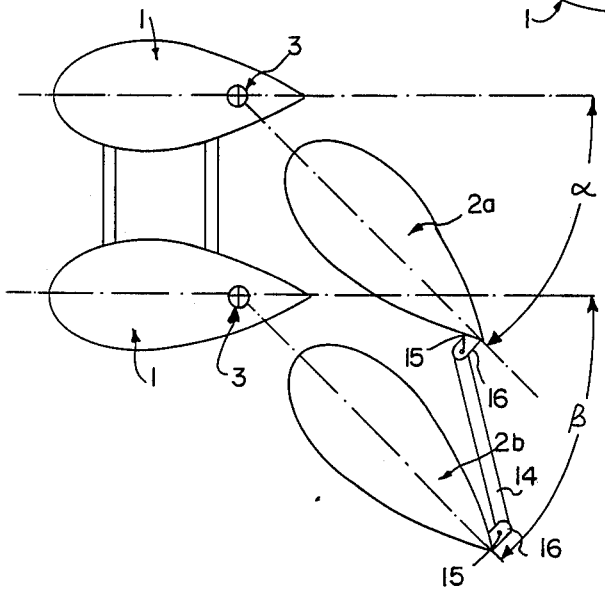
FIG. 7

WINGSAIL STALLING

This invention which is a continuation-in-part of my application Ser. No. 005,167 filed Jan, 2, 1987, now U.S. Pat. No. 4,770,113 relates to wingsail airfoils for land or marine vehicles and to arrangements for stalling wingsail airfoils.

A wingsail airfoil is mounted and operated somewhat differently to the more familiar aeroplane wing; it is mounted with the span upright and the airfoil section plane substantially horizontal, and since the vehicle to which the wingsail is attached is supported by land or water the airfoil is used to supply or augment propulsive power which for practical purposes needs to be capable of being applied both left and right of the wind. The type of wingsail assembly with which the present invention is concerned is a self-setting or self-trimming wingsail assembly. Such a wingsail assembly comprises a set of airfoils, termed hereinafter a sailset, having at least one thrust wingsail that reacts the propulsive force and is freely rotatable about an upright axis so that it can be trimmed to different angles in accordance with the wind and desired direction of travel, and at least one auxiliary airfoil (usually a tail airfoil) mounted on a boom or booms rigidly connected to the thrust wingsail and which is used to trim the thrust wingsail as explained hereinafter.

The thrust wingsail is of multi-element structure comprising a leading airfoil element and a trailing airfoil element positioned closely behind the leading element, the trailing element being laterally pivotable with respect to the leading element so that the wingsail adopts an asymmetrical configuration for thrust left or right of the wind. The trailing element can be locked in the thrusting position and released for returning to the aligned position or to a mirror image cambered position. Generally the axis of free rotation of the sailset passes through the zone containing the upstream and downstream range of locations of the centre of pressure of the sailset. When the airfoils are all in line the sailset will be rotated like a weathercock to the position of minimum resistance. If the thrust wing is then set to the thrusting configuration by rotating and locking the trailing element the wind creates a turning moment about the main axis. However, the auxiliary airfoil can also be independently rotated and although much smaller it is, by virtue of its distance from the main axis, capable of exerting a comparable moment. Thus by selection of the angular deflection of the auxiliary airfoil (that is selection of its moment compared with the thrust wing moment about the main axis for a given angular deflection of the thrust wing) the trim angle of the thrust wing to the wind can be selected, and upon a change of wind direction the resulting change in the moments of the thrust wing and auxiliary airfoil about the main axis will cause a natural rotation of the sailset until the moments again balance when the trim angle to the wind is restored to its original value.

The direction of travel of the vehicle with respect to prevailing wind direction may be considered to fall into three general categories: towards the wind, broadly across wind, and away from or downwind, and for each of these categories different settings with respect to the wind are preferable. In between the general categories the best settings will be intermediate those exemplified below with respect to the general categories.

If the vehicle is being propelled towards the wind the trim is usually adjusted to provide the maximum possible aerodynamic efficiency, commonly termed the left/drag ratio; which is the ratio of the output force resolved into components at right angles to the wind and in the direction of the wind. If the direction is across the wind the trim is adjusted to provide the maximum force available without stalling, and if the travel is downwind then the downwind component of force is maximised, with stalling deliberately enabled if found more effective.

The present invention is particularly concerned with multi-plane sailsets and with configurations that enable maintainance of full stall for maximum speed in running downwind. During stalling the airflow over the airfoils is eddying and turbulent such that an auxiliary tail airfoil may become blanketed and be rendered less effective in controlling the trimming of the thrust wings in stalling conditions. There may also be an additional moment resisting achievement of full stall created by the shifting of the centre of pressure of the thrust wing rearwardly away from the main rotation axis.

Accordingly, the present invention provides a wingsail arrangement comprising a plurality of thrust wings each of which comprises an upright leading airfoil having a leading edge and a trailing edge and an upright trailing airfoil having a leading edge and a trailing edge the leading edge of the trailing airfoil being positioned closely behind the trailing edge of the leading airfoil and means for mounting the trailing airfoil for pivoting movement about an upright axis relative to the first airfoil from an aligned position in which the trailing airfoil is aligned coplanar with the leading airfoil to positions to each side of and angularly displaced from the aligned position, and means for maintaining a lesser distance between the trailing edges of at least a pair of trailing airfoils of said plurality of thrust wings than between the leading edges of said pair.

The means for maintaining a lesser distance may comprise a mechanical linkage of a respective member rigidly attached to each of the trailing airfoils of said pair and a rigid link pivotally connected to each member.

In a second embodiment the invention provides a wingsail arrangement comprising a plurality of thrust wings each of which comprises an upright leading airfoil having a leading edge and a trailing edge and an upright trailing airfoil having a leading edge and a trailing edge the leading edge of the trailing airfoil being positioned closely behind the trailing edge of the leading airfoil and means for mounting the trailing airfoil for pivoting movement about an upright axis relative to the first airfoil from an aligned position in which the trailing airfoil is aligned coplanar with the leading airfoil to positions to each side of and angularly displaced from the aligned position, and means for establishing a lesser distance between the trailing edges of at least a pair of trailing airfoils of said plurality of thrust wings than between the leading edges of said pair as the trailing airfoils are angularly displaced from the aligned position.

The invention is now described by way of example with reference to the accompanying drawings in which:

FIG. 1 illustrates schematically a plan view of a single plane wingsail sailset;

FIG. 3 is a schematic plan of twin plane thrust wings;

FIG. 4 illustrates a first embodiment of the invention on twin plane thrust wings shown in the symmetrical position;

FIG. 5 illustrates the thrust wings of FIG. 4 in an angularly deflected configuration set to thrust right of wind;

FIG. 6 illustrates a second embodiment of the invention on twin plane thrust wings, and FIG. 7 shows the thrust wings of FIG. 6 in the thrusting configuration right of the wind.

Figure 2:
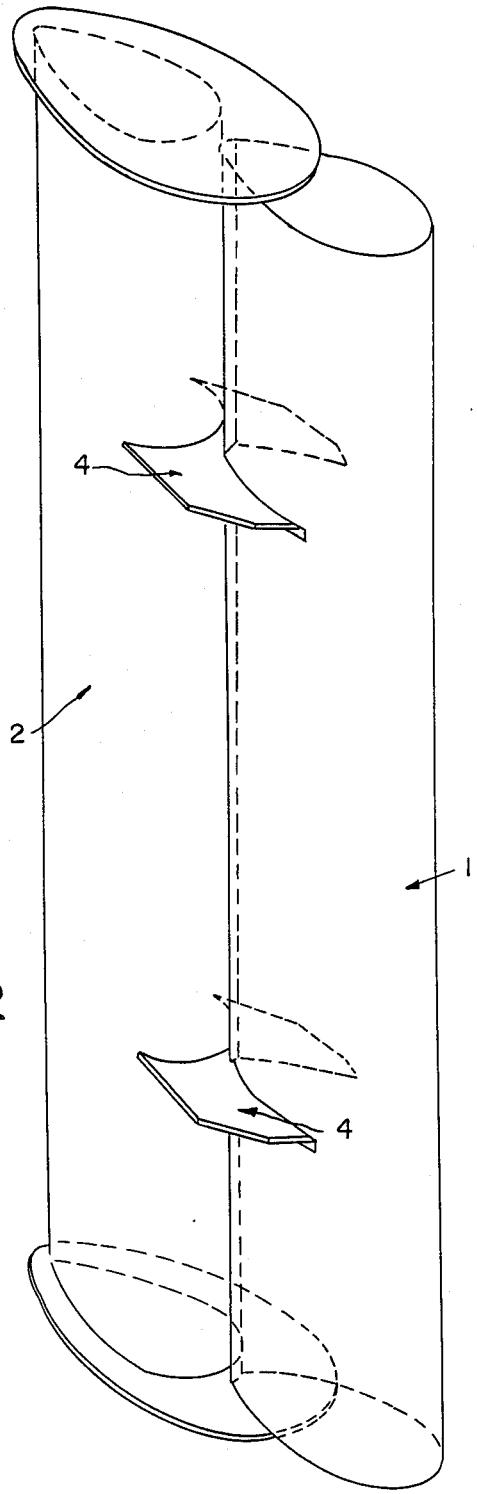
FIG. 2 is a schematic perspective view of part of a thrust wing assembly.

Referring to FIG. 1, the main parts of a single plane wingsail sailset are shown schematically in plan view. A main thrust wing is composed of a leading element 1 and a trailing element (termed a flap) 2. The flap 2 is pivotable from side to side about a pivot axis 3 located within the leading section 1, the flap being connected to the pivot axis 3 by a series of hinge arms 4 illustrated more clearly in FIG. 2. The pivot axis 3 may not be a continuous axis, it may comprise a series of aligned axes associated with respective hinge arms 4. A small slat (not shown) that forms an extension to the trailing edge of the leading element 1 when the trailing section 2 is pivoted out of alignment with the leading element 1 is preferably provided. Such a slat is the subject of my U.S. Pat. Nos. 4,467,741 and 4,563,970.

A tail airfoil is pivotally mounted about axis 5 on booms 6, usually provided towards or at the top and bottom of the thrust wings, the booms being rigidly connected to the leading element 1. Hydraulic or pneumatic cylinders 7, 8 or other movement mechanisms are provided for respectively rotating the flap 2 and tail about their pivot axes 3 and 5, these fluid cylinders or other mechanisms may conveniently be mounted on the booms 6 which also form an end plate assembly. A counterbalance 9 for the tail is also provided so that the sailset is mass balanced about an axis 10, about which the sailset is freely rotatable. In order to dynamically balance the sailset the counterbalance is located at approximately half height on the leading element although some inertial response advantage can be gained by locating the counterbalance a little below the half height. A multi-plane sailset comprises the same elements as shown and described with reference to FIG. 1, but has a plurality of sets of thrust wings, each having a leading element 1 and flap 2. A single auxiliary tail airfoil is still usually employed although multiple auxiliary airfoils may be used. If the multi-plane sailset has an odd number of thrust wings the central structure is similar to that shown in FIG. 1 with the main axis 10 aligned with the central leading section. For an even number of thrust wings the main axis 10 will lie midway between the innermost leading sections. The thrust wings of a multiplane sailset may be linked so that one flap (usually the flap on a central wing of an odd numbered multiplane) is controlled as a master with the rest driven as slaves, or alternatively each flap may be separately driven with the drives controlled so that whether by virture of physical interconnection or by a control mechanism the flaps are moved in unison.

FIG. 3 illustrates a twin plan set of thrust wings, each thrust wing comprising a leading element 1 and a trailing flap element 2. The flaps 2 are each pivotable about an axis 3 located on the centre chord of the respective leading elements, so that each flap is capable of being angularly deflected laterally to each side of its respective leading element. The spacing of the leading element is preferably fixed and maintained by members interconnecting the two leading elements at intervals in the upright direction, so that the leading elements are maintained parallel to one another.

The natural arrangement is for the flaps to be maintained parallel to one another, so that the angular deflection of each flap relative to its leading element is the same. However, in a first embodiment of the invention the flap initial positions are made non-parallel so that the position shown in FIG. 4 is adopted in the symmetrical position, with the distance between trailing edges of the flaps being less than the distance between the leading edges. The flaps 2 are interconnected by links which comprise outwardly directed arms 11 rigidly connected to the trailing edge of the flaps and a link 12 of the same length as the interplane distance between the chords of the tow leading airfoils pivotally connected by pivots 13 at its ends to respective ones of the arms 11, the pivots 13 being coplanar with chordal plane of the leading element on the centre line where the trailing edge of the trailing section would be if it had not been angled inwardly. The effect of such angular setting in the symmetrical position is that once the flaps are deflected, as shown in FIG. 5, the leeward flap (the deflected configuration being concave to the wind) reaches a greater angle of deflection than the windward flap, and thus as stalling is approached the leeward wing stalls first and more deeply than the windward wing thus tending to hold the wing at the stalled angle. The extent of the initial angular disparity determines the difference in the flap angles, a difference of about 2° between the angles of adjacent flaps being preferred.

In a similar embodiment for a three wing system, the central flap is left parallel with the leading elements and the outer flaps angled in the symmetrical positions to give for example angles of +38°, +40° and +42° when deflected, or on the opposite tack angles of −38°, −40° and −42°. For configurations with four or more wings, pairs of wings may have differing degrees of initial angular disparity in order to maintain the leeward progression to deeper stalling.

In an alternative embodiment of the invention shown in FIGS. 6 and 7 the flaps are linked so that they are parallel in the central non-deflected position but still exhibit differing degrees of angular deflection when deflected so that the leeward flap is at a greater angle. FIG. 6 shows the in line configuration, the leading airfoils being rigidly connected parallel to each other and the spacing of the flaps 2 being maintained parallel and coplanar with the leading airfoils by a link 14 that is pivotally connected at 15 to respective arms 16 attached to the trailing edges of the flaps. The arms 16 are inwardly directed towards the plane of symmetry of the sailset so that the length of the link 14 is less than the distance between the respective chord planes of the wings.

Considering now FIG. 7 which shows the flaps angularly deflected towards the wind (shown by the arrow) the leeward flap 2*a* is deflected through an angle $\alpha$, but the windward flap 2*b* is deflected through a smaller angle $\beta$ due to the non-parallelogram linkage formed between the hinge axes 3 of the flaps and the pivotal connections 15 on the arms. The precise angular difference between $\alpha$ and $\beta$ depends upon the geometry of the quadrilateral joining the hinge axes 3 and pivotal connections 15, and the length of the arms 16 and linkage 14 are selected according to the desired angular disparity at full flap deflection. It will be realised that at less than full flap deeflection the angular disparity will be intermediate that at zero deflection, i.e. in the symmetrical position (which is zero angular disparity in FIG. 5) and that at full flap deflection (usually of the order of 2° per wing in about 40° of deflection).

The non parallel linkage principle described with reference to the embodiments of FIGS. 6 and 7 may be utilised in combination with a non-deflected flap setting in which there is an initial angular disparity, in which case this initial angular disparity plus the linkage geometry will determine the final angular disparity in the fuly deflected position of the flap. An initial angular disparity in combination with a non parallel linkage need not only have the flap trailing edges convergent, settings may be chosen in which the zero deflection (symmetrical position) has the trailing edges of the flaps divergent.

The leading airfoils have been described as spaced with their chord lines parallel, but it should be realised that it is possible for departures from parallel to be made so that the chordal planes of the leading airfoils are divergent or convergent as compared with the paralell arrangement.

I claim:

1. A wingsail arrangement comprising a plurality of thrust wings each of which comprises an upright leading airfoil having a leading edge and a trailing edge and an upright trailing airfoil having a leading edge and a trailing edge the leading edge of the trailing airfoil being positioned closely behind the trailing edge of the leading airfoil and means for mounting the trailing airfoil for pivoting movement about an upright axis relative to the first airfoil from an aligned position in which the trailing airfoil is aligned coplanar with the leading airfoil to positions to each side of an angularly displaced from the aligned position, and means for maintaining a lesser distance between the trailing edges of at least a pair of trailing airfoils of said plurality of thrust wings than between the leading edges of said pair.

2. A wingsail arrangement according to claim 1 in which the means for maintaining a lesser distance comprises a mechanical linkage.

3. A wingsail arrangement according to claim 2 in which the mechanical linkage comprises a respective member rigidly attached to each of the trailing airfoils of said pair and a rigid link pivotally connected to each member.

4. A wingsail arrangement according to claim 1 comprising two thrust wings.

5. A wingsail arrangement according to claim 1 comprising at least three thrust wings.

6. A wingsail arrangement according to claim 5 in which said means for maintaining provides a progressive angular disparity in the trailing airfoils when they are angularly displaced from the aligned position with that trailing airfoil that is on the windward side being least angularly displaced.

7. A wingsail arrangement comprising a plurality of thrust wings each of which comprises an upright leading airfoil having a leading edge and a trailing edge and an upright trailing airfoil having a leading edge and a trailing edge the leading edge of the trailing airfoil being positioned closely behind the trailing edge of the leading airfoil and means for mounting the trailing airfoil for pivoting movement about an upright axis relative to the first airfoil from an aligned position in which the trailing airfoil is aligned coplanar with the leading airfoil to positions to each side of and angularly displaced from the aligned position, and means for establishing a lesser distance between the trailing edges of at least a pair of trailing airfoils of said plurality of thrust wings than between the leading edges of said pair as the trailing airfoils are angularly displaced from the aligned position.

8. A wingsail arrangement according to claim 7 in which said means for establishing comprises a non-parallelogram mechanical linkage.

9. A wingsail arrangement according to claim 8 in which the mechanical linkage comprises a respective member rigidly attached to each of the trailing airfoils of said pair and extending towards the other of said pair and a rigid link pivotally connected to each member.

10. A wingsail arrangement according to claim 7 comprising two thrust wings.

11. A wingsail arrangement according to claim 7 comprising at least three thrust wings.

12. A wingsail arrangement according to claim 7 in which said means for establishing provides a progressive angular disparity in the trailing airfoils of said plurality when they are angularly displaced from the aligned position with that trailing airfoil that is on the windward side being least angularly displaced.

* * * * *